US005469753A

United States Patent [19]

Vadin-Michaud et al.

[11] Patent Number: 5,469,753

[45] Date of Patent: Nov. 28, 1995

[54] STARTER UNIT FOR A MOTOR VEHICLE ENGINE

[75] Inventors: Gilles Vadin-Michaud, Villeurbanne; Thierry Florentin, Villefontaine, both of France

[73] Assignee: Valeo Equipments Electriques Moteur, Creteil, France

[21] Appl. No.: 172,425

[22] Filed: Dec. 22, 1993

[30] Foreign Application Priority Data

Dec. 23, 1992 [FR] France ..... 9215634

[51] Int. Cl.[6] ..... F02N 15/06

[52] U.S. Cl. ..... 74/7 A; 290/48; 384/273

[58] Field of Search ..... 74/7 R, 7 A, 7 C; 290/48; 384/273

[56] References Cited

U.S. PATENT DOCUMENTS

| | | | |
|---|---|---|---|
| 4,649,285 | 3/1987 | Mazzorana et al. | 290/48 |
| 4,958,530 | 9/1990 | Jaseck et al. | 74/7 A |
| 5,012,686 | 5/1991 | Morishita et al. | 74/7 A |

FOREIGN PATENT DOCUMENTS

| | | | |
|---|---|---|---|
| 2555670 | 5/1985 | France . | |
| 2567586 | 1/1986 | France . | |
| 2673247 | 8/1992 | France . | |
| 3005242 | 2/1980 | Germany . | |
| 60-95189 | 5/1985 | Japan | 290/48 |

OTHER PUBLICATIONS

Patent Abstracts of Japan, vol. 9, No. 242 (M–417)(1965) 28 Sep. 1985.—60–95189.

French Search Report—Fr 9215634 Sep. 13, 1993.

*Primary Examiner*—Allan D. Herrmann

*Attorney, Agent, or Firm*—Morgan & Finnegan

[57] ABSTRACT

A starter unit for an internal combustion engine, especially a motor vehicle engine, comprises an electric motor and an electromagnetic actuator, having parallel axes and being secured on a starter frame or chassis which has at least one starter nose. The starter nose defines a hood which envelops the end of the output member of the electromagnetic actuator and the free end of the shaft of the motor. The motor shaft carries a Bendix gear or pinion. The unit also includes an actuating lever for controlling axial displacements of the Bendix gear. The actuating lever pivots about an axis which is substantially at right angles to the axes of the motor and actuator. The actuating lever has a pivot shaft comprising two ends and mounted pivotally in a two-part bearing which comprises a first bearing part connected to the starter nose, together with a complementary second bearing part which is formed, in facing relationship with the first bearing part, in a component which is connected to the casing of the motor and/or to the casing of the electromagnetic actuator.

9 Claims, 2 Drawing Sheets

STARTER UNIT FOR A MOTOR VEHICLE ENGINE

FIELD OF THE INVENTION

The present invention relates to a starter unit, and more particularly a starter unit for an internal combustion engine of a motor vehicle.

BACKGROUND OF THE INVENTION

Essentially, a starter unit comprises an electric motor and an electromagnetic actuator, the axes of rotation and actuation (respectively) of which are parallel to each other. The motor and actuator are secured on a starter frame, or chassis, which includes at least one so-called starter nose. The starter nose is in the form of a hood which envelops, firstly, the outer end of the output member or ram of the electromagnetic actuator, which is arranged to move in forward and backward axial motion, and secondly, the free end of the output or armature shaft of the motor. This motor shaft carries a so-called Bendix gear or pinion. The starter unit also includes an actuating lever which controls the axial movements of the Bendix gear, and which is mounted for pivoting movement about a geometrical axis which is substantially at right angles to the axes of the motor and of the electromagnetic actuator. One end of the actuating lever is coupled to the output member of the electromagnetic actuator, while its other end is in the form of a fork which acts on a thrust ring of the Bendix gear or pinion.

Examples of various designs of such a type of starter are for example illustrated in the specification of French published patent application FR 2 673 247A, in which the frame of the starter unit includes a transverse plate element which lies in a plane at right angles to the axes of the actuator and motor. The frame also includes a starter nose. In that arrangement, the actuating lever is made as a single component, the central portion of which has an articulating or pivot pin passing through it. The ends of this pivot pin are received in a component which defines a bearing having a stirrup-shaped profile. This bearing is carried on the intermediate plate of the starter frame. The operations of assembling and fitting the actuating lever, so that it can undergo its pivoting movement, are very complicated and expensive.

One example of a similar design is illustrated in the specification of French published patent application FR 2 567 586A, in which the pivot pin of the actuating lever is again mounted in a component which defines a bearing and which is carried on the intermediate flange or plate. In addition, designs are known in which the casing of the electromagnetic actuator, and that of the electric motor, are secured directly by screw fasteners on to the starter nose, with the articulating member of the actuating lever being itself fixed between the casings of the electromagnetic actuator and of the electric motor.

DISCUSSION OF THE INVENTION

An object of the present invention is to provide a design of starter unit of the general type mentioned above, but in which the means by which the actuating lever is pivotally mounted are of very simple design and lead to a reduction in the assembly operations, with such operations being easily able to be carried out by automatic means.

According to the invention, a starter unit for an internal combustion engine, especially a motor vehicle engine, the starter unit being of the type comprising an electric motor and an electromagnetic actuator, the electric motor and actuator having parallel axes and being secured on a starter frame, which comprises at least a starter nose defining a hood which envelops the end of the output member of the electromagnetic actuator and the free end of the shaft of the motor which carries a Bendix gear or pinion, the starter unit further comprising an actuating lever which controls the axial displacements of the Bendix gear, and which is mounted for pivoting movement about an axis which is substantially perpendicular to the axes of the motor and electromagnetic actuator, is characterised in that the actuating lever has a pivot shaft, each end of which is mounted for pivoting movement in a two-part bearing, with the latter comprising a first bearing part connected to the starter nose and a second, complementary, bearing part, which is formed in facing relationship to the said first bearing part in a member which is connected to the casing of the motor and/or to the casing of the electromagnetic actuator.

Some further preferred features of the invention, applicable to a starter unit in accordance with the invention separately or in appropriate combinations, are as follows.

Each said first bearing part is a first cylindrical half bearing which is made integrally with the starter nose, and which projects axially from the inner face of the latter.

The two said first half bearings are formed on the end of a first plate element which is integral with the starter nose, and which projects from the inner face of the latter in a plane which is substantially at right angles to the plane containing the axes of the said motor and electromagnetic actuator.

Each said second bearing part is in the form of a cylindrical half bearing formed at the end of a mounting wedge which is arranged between two portions, in facing relationship with each other, of the respective front portions of the casings of the motor and electromagnetic actuator which face towards the inner face of the starter nose.

The two said second half bearings are formed on the end of a front portion, in the form of a plate element, of the mounting wedge, the said plate element extending axially from a rear mounting portion of the said mounting wedge, and towards the starter nose, and lying in a plane which is substantially at right angles to the plane containing the axes of the actuator and motor.

The said front portion, in the form of a plate element, of the mounting wedge lies in the same plane as the said plate element of the starter nose.

The rear mounting portion of the mounting wedge has two opposed concave engagement surfaces, one of which cooperates with a cylindrical portion of the casing of the motor, the other said engagement surface cooperating with a cylindrical portion of the casing of the electromagnetic actuator, the said cylindrical portions being in facing relationship with each other.

One of the said concave engagement surfaces includes an indexing or locating finger which extends radially from the concave surface, and which is received in a complementary aperture formed in the corresponding portion of the motor casing or of the casing of the electromagnetic actuator.

The mounting wedge is in the form of a component which is moulded in a plastics material.

The the pivot axis of the actuating lever for the bendix gear lies in a plane which extends substantially between the casings of the motor and of the electromagnetic actuator.

The actuating lever and its pivot shaft are formed integrally with each other as a single component by moulding.

Further features and advantages of the present invention will appear more clearly on a reading of the detailed description which follows, of a preferred embodiment of the invention by way of example only, with reference to the accompanying drawings.

DESCRIPTION OF A PREFERRED EMBODIMENT OF THE INVENTION

Figure 1:
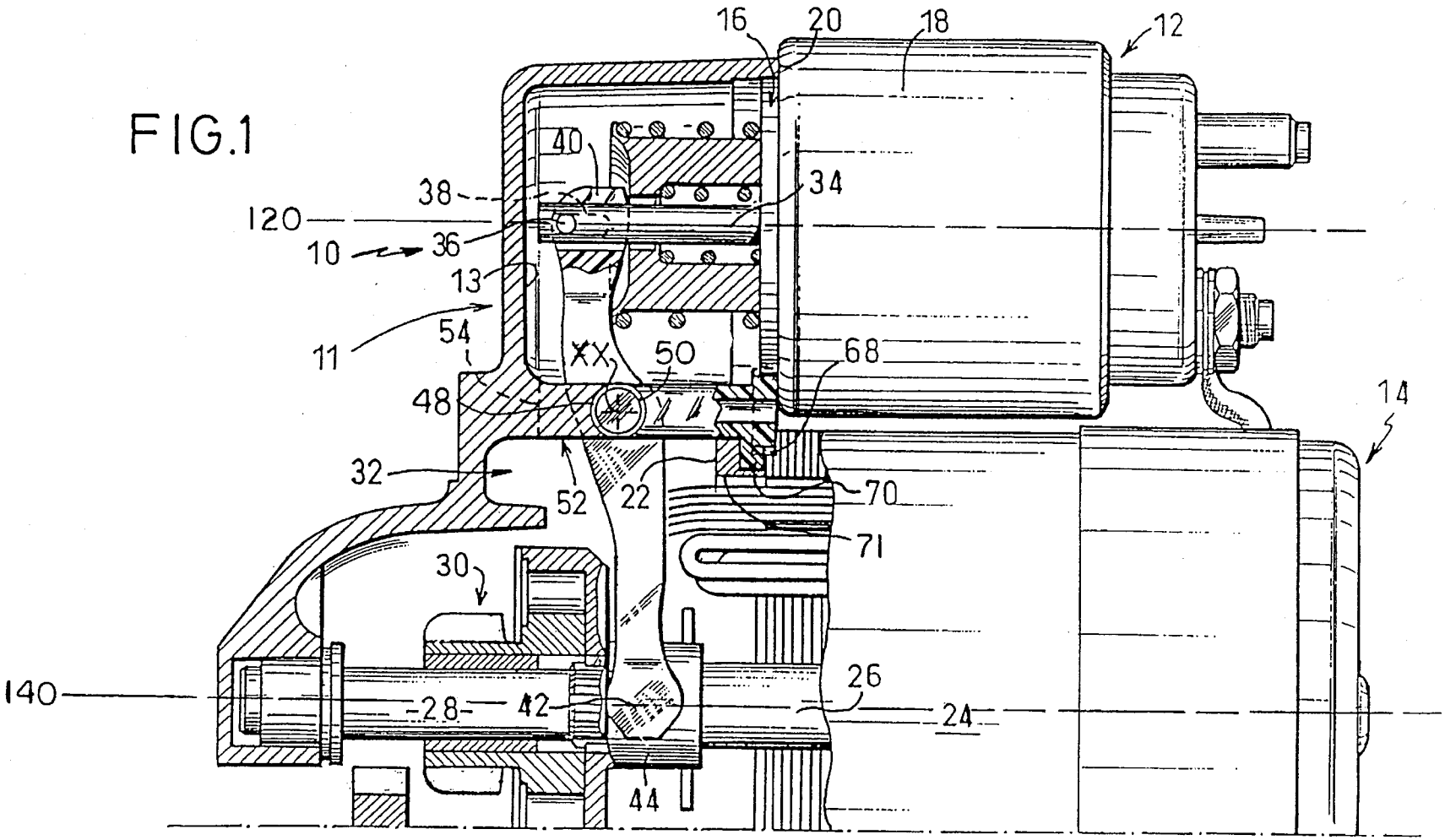
FIG. 1 is a view showing part of a starter unit in accordance with the invention, seen in plan view, partly in a cross section taken on a plane containing the axes of the electromagnetic actuator and the electric motor of the starter unit.

The starter unit 10 shown in FIG. 1 has a starter unit frame or chassis, the main element of which is a starter nose 11 which is made in the form of a moulded component, on which an electromagnetic actuator 12 and an electric motor 14 are fixed. Electric motor 14 defines a first axis 140 and electromagnetic actuator 12 defines a second axis 120. The shouldered front portion 16 of the casing 18 of the electromagnetic actuator 12 is enclosed in a corresponding portion of the rear face 20 of the starter nose 11, while a front portion 22 (see FIG. 2) of the casing 24 of the electric motor 14 is also received in a corresponding portion (not shown) of the starter nose 11. The electromagnetic actuator 12 and the electric motor 14 may be secured to the starter nose 11 by securing screws (not shown).

The electric motor 14, which may also be in the form of a motorised reduction gear, includes an output shaft or armature shaft 26, the free end 28 of which projects from the front portion of the casing 24, and which is received in the starter nose 11. The shaft 26 carries a Bendix gear or pinion 30 which is coupled in rotation to the shaft and which is arranged to be displaced axially along that shaft 26 by means of a pivoting actuating lever 32. This lever 32 is controlled by the electromagnetic actuator 12.

The actuating lever 32 is mounted for pivoting movement about a geometric axis X—X which is at right angles to the plane of FIG. 1 containing the axis of rotation of the armature shaft 26 of the electric motor 14 and the longitudinal axis of the output member or ram 34 of the electromagnetic actuator 12.

The electromagnetic actuator 12 is generally of a known type of construction which will not be described in any detail here. Apart from the supply of electrical energy to the motor 14 through a system of the contacter type, the actuator 12 is arranged to operate the actuating lever 32 in pivoting movement, by means of its output member 34. The latter is generally in the form of a rod, the free end of which carries a transverse cotter pin 36, which is received in a groove 38 formed in the upper end of the actuating lever 32. The lower portion 42 of the actuating lever 32 is in the form of a fork which cooperates with a control surface 44 of the bendix gear 30.

Figure 2:
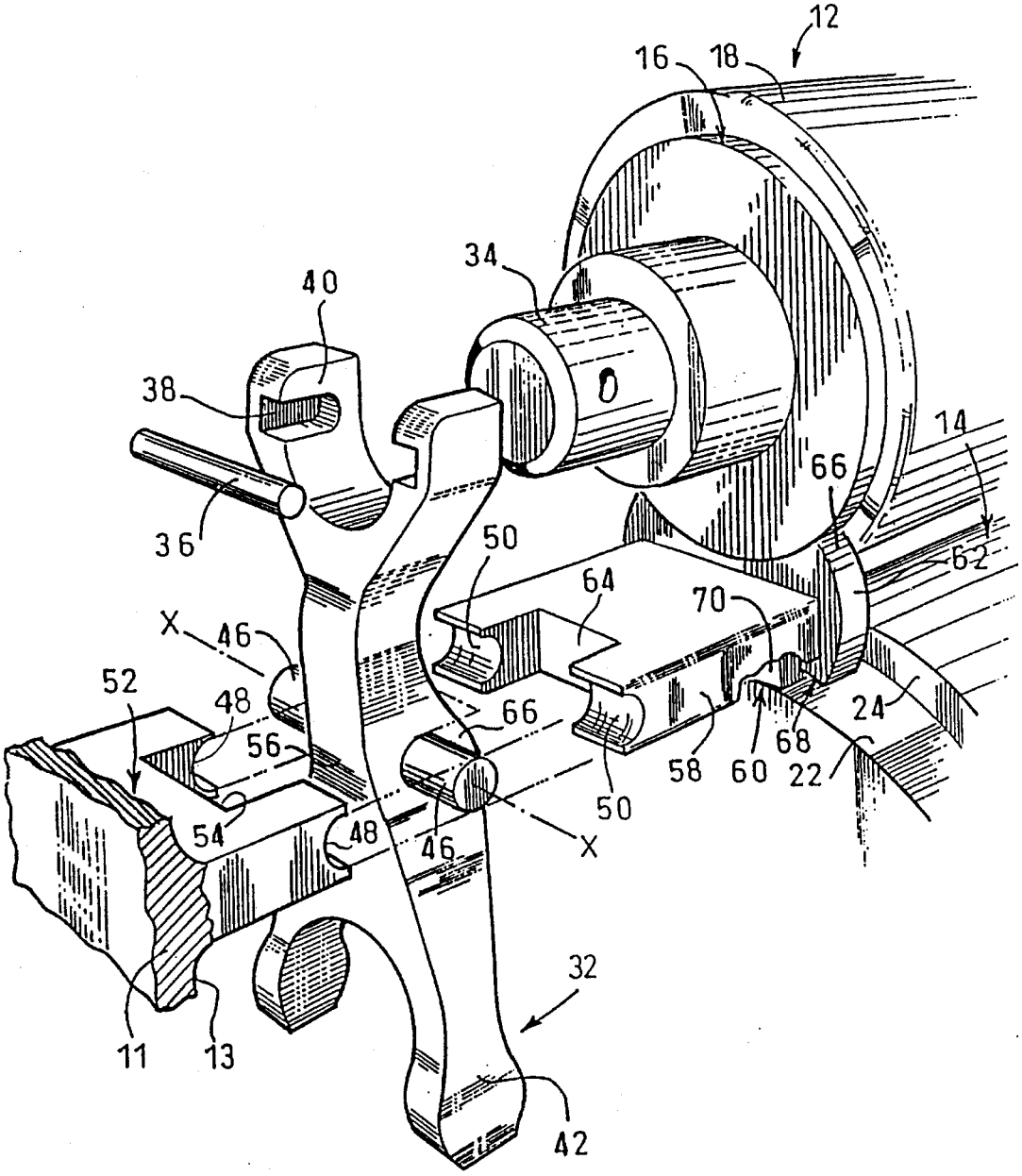
FIG. 2 is an exploded perspective view on a larger scale, showing main components of the articulating means for the actuating lever of the Bendix gear or pinion of the starter unit, incorporating features of the invention.

The articulating means for the actuating lever 32, whereby it can pivot about the fixed geometric axis X—X, will now be described with reference to FIGS. 1 and 2. In the embodiment shown in these Figures, the lever 32 is a single component, which is made by moulding in a suitable plastics material. Its articulation or pivot axis is defined by two stub shafts or trunnions 46, aligned with each other and together constituting a cylindrical pivot shaft having the axis X—X. The two trunnions 46 extend in opposite directions outwardly from the opposed faces of the body of the actuating lever 32, and may also be referred to as pivot shaft portions. Each pivot shaft portion 46 is mounted for rotation in a two-part bearing, the two parts of which comprise a first concave cylindrical half bearing 48 and a second, complementary, concave cylindrical half bearing 50.

The two half bearings 48 are formed in the end of a plate element 52 which projects from the inner face 13 of the starter nose 11. The plate element 52 is made by moulding it integrally with the starter nose 11, and it lies in a plane, containing the axis X—X, which is parallel to the axes of the electromagnetic actuator 12 and electric motor 14. The plate element 52 is so positioned that the axis X—X lies in a horizontal plane with reference to FIG. 1, extending between the casings 18 and 24 of the electromagnetic actuator 12 and of the electric motor 14 respectively.

The front portion of the plate element 52 is formed with a central recess 54, so that the element 52 is in the shape of a fork such that movements of the central portion 56 of the actuating lever 32, in facing relationship with the recess 54, are possible.

The two second concave cylindrical half bearings 50 are formed at the end of the front portion 58 of a mounting wedge 60. This front portion 58 is in the form of another rectangular plate element. The rear portion 62 of the mounting wedge 60 is fitted between the front portion 16 of the casing 18 of the actuator 12 and the front portion 22 of the casing 24 of the motor 14. The wedge 60 is a component which is moulded in a suitable plastics material, with its front portion, i.e. the rectangular plate element 58, lying in a plane which, in the assembled position as shown in FIG. 1, is coincident with the plane in which the plate element 52 of the starter nose 11 lies. Again, the plate element 58 is formed with a recess 64, so that pivoting movements of the corresponding face 66 of the central portion of the body of the actuating lever 32 about the pivot axis X—X can take place.

The rear portion 62 of the mounting wedge 60 is in the form of a vertical plate element which lies in a plane at right angles to the plane in which the front portion or plate element 58 lies. The vertical plate element 62 has a first, concave, cylindrical surface 66 which is complementary to the convex cylindrical surface of the front portion 16 of the casing 18 of the electromagnetic actuator 12. The vertical plate element 62 also has a second, again concave, cylindrical engagement surface 68 which is complementary to the outer convex cylindrical surface of the front portion 22 of the casing 24 of the electric motor 14. Thus the vertical plate element 62 is partly enclosed between the two cylindrical front portions of the electromagnetic actuator 12 and of the electric motor 14 respectively.

In order to maintain the vertical plate element 62 in position between these two last mentioned elements, it includes in its lower portion a mounting and indexing finger 70. This finger extends radially downwardly and projects from the concave cylindrical engagement surface 68, so as to be received in a complementary aperture 71 formed in the front portion 22 of the motor casing 24. The wedge 60 is thus positioned, and retained in position, between the two main components 12 and 14 of the starter unit.

The operation of fitting the actuating lever 32 is thus made particularly simple, because it is simply placed in engagement on the two concave cylindrical half bearings 50 of the mounting wedge 60, the pivot bearing itself then being completed during the final fitting operation of the starter nose 11.

The manufacturing costs of the articulating means are, in particular, reduced because the first half bearings 48 are made integrally during the moulding operation of the starter nose 11, and because the second half bearings 50 are formed at the end of a wedge 60 of plastics material.

The fitting operations are simplified because they require no operation to introduce a pivot pin or similar separate component in its axial direction; nor do they require any deformation or separation of components in order to introduce such a pivot pin or the like.

What is claimed is:

1. For an internal combustion engine, a starter unit comprising: a starter frame; an electric motor defining a first axis and carried by the starter frame; an electromagnetic actuator defining a second axis parallel to said first axis and carried by the starter frame, said motor having a shaft rotatable on said first axis and having a free end, the actuator having an output member on said second axis and having a free end, and a casing including at least one starter nose enveloping said free ends of the motor shaft and actuator output member; and a pinion carried on the motor shaft, the starter unit further including: an actuating lever having a first end and a second end, said first end of the actuating lever being coupled to the output member of said actuator, said second end of the actuating lever being coupled with a pinion; and a pivot mounting the actuating lever in the starter frame and defining a pivot axis for the actuating lever substantially perpendicular to said first and second axes, whereby the actuating lever controls axial displacements of the pinion, wherein the actuating lever includes a pivot shaft defining two ends thereof, said pivot comprising said pivot shaft and a two-part bearing cooperating with the latter, the two-part bearing comprising a first bearing part connected to the starter nose and a second bearing part complementary to the first bearing part, the starter unit further including a member connected to one casing of the motor and the actuator, with said second bearing part being formed in said member, wherein the starter nose has an inner face, said first bearing part comprising a cylindrical half bearing projecting integrally from said inner face, and further having two said first half bearings, the starter nose having an integral plate element projecting from its inner face in a plane substantially at right angles to a plane containing said first and second axes and having an end defining the two first half bearings.

2. A starter unit according to claim 1, wherein said pivot shaft lies in a plane which extends substantially between the motor and actuator casings.

3. A starter unit according to claim 1, wherein said pivot shaft is molded integrally with the actuating lever.

4. For an internal combustion engine, a starter unit comprising: a starter frame; an electric motor defining a first axis and carried by the starter frame; a electromagnetic actuator for defining a second axis parallel to said first axis and carried by the starter frame, said motor having a shaft rotatable on said first axis and having a free end, the actuator having an output member on said second axis and having a free end, and a casing including at least one starter nose enveloping said free ends of the motor shaft and actuator output member; and a pinion carrier on the motor shaft, the starter unit further including: an actuating lever having it first end and a second end, said first end of the actuating lever being coupled to the output member of said actuator, said second end of the actuating lever being coupled with a pinion; and a pivot mounting the actuating lever in the starter frame and defining a pivot axis for the actuating lever substantially perpendicular to said first and second axes, whereby the actuating lever controls axial displacements of the pinion, wherein the actuating lever includes a pivot shaft defining two ends thereof, said pivot comprising said pivot shaft and a two-part bearing cooperating with the latter, the two-part bearing comprising a first bearing part connected to the starter nose and a second bearing part complementary to the first bearing part, the starter unit further including a member connected to one casing of the motor and the actuator, with said second bearing part being formed in said member, wherein each of the casings of the motor and the actuator has a respective front portion, the starter nose having an inner face, said front portions of the casings being directed towards said inner face, with each said front portion having a respective mounting portion, said mounting portions being in facing relationship with each other, said member that has the second bearing part being a mounting wedge arranged between the two mounting portions and defining an end thereof, with said second bearing part comprising a cylindrical second half bearing formed in said end of the mounting wedge.

5. A starter unit according to claim 4, wherein said mounting wedge comprises a front portion in the form of a second plate element, and a rear mounting portion, said front portion extending axially from said rear portion towards the starter nose and lying in a plane substantially at fight angles to the plane containing said first and second axes, said front portion defining an end thereof, there being two said second half bearings formed in said end of the front portion of the mounting wedge.

6. A starter unit according to claim 5, having two said first half bearings, the starer nose having an integral plate element projecting from its said inner face in a plane substantially at fight angles to a plane containing said first and second axes and having an end defining the two first half bearings, said first and second plate elements being coplanar.

7. A starer unit according to claim 5, wherein said rear portion of the mounting wedge defines a first concave engagement surface and a second concave engagement surface opposed to said first engagement surface, the motor casing and actuator casing having respective cylindrical portions cooperating with said first and second engagement surfaces respectively.

8. A starter unit according to claim 7, wherein one of said concave engagement surfaces defines an indexing finger extending radially therefrom, with the cooperating cylindrical casing portion defining a complementary aperture receiving said finger.

9. A starter unit according to claim 4, wherein the mounting edge is molded in one piece from plastic material.

* * * * *

UNITED STATES PATENT AND TRADEMARK OFFICE

CERTIFICATE OF CORRECTION

PATENT NO. : 5,469,753

DATED : November 28, 1995

INVENTOR(S) : Gilles Vadin-Michaud et al.

It is certified that error appears in the above-indentified patent and that said Letters Patent is hereby corrected as shown below:

column 6, line 4, delete "it" and insert therefor -- a -- column 6, line 35, delete "fight" and insert therefor -- right --

Signed and Sealed this

Twentieth Day of February, 1996

*Attest:*

Bruce Lehman

BRUCE LEHMAN

*Attesting Officer*

*Commissioner of Patents and Trademarks*